United States Patent [19]

Plana

[11] Patent Number: 4,693,004

[45] Date of Patent: Sep. 15, 1987

[54] ENVELOPE OPENER

[76] Inventor: Salvio Plana, 1500, Stanley, #333b, Montreal, Quebec, Canada, H3A 1R3

[21] Appl. No.: 845,852

[22] Filed: Mar. 28, 1986

[51] Int. Cl.[4] ..... B26B 13/00

[52] U.S. Cl. ..... 30/265; 30/287; 30/292

[58] Field of Search ..... 30/265, 294, 287, 292

[56] References Cited

U.S. PATENT DOCUMENTS

| | | | |
|---|---|---|---|
| 1,474,856 | 11/1923 | Starkl | 30/265 |
| 2,647,313 | 8/1953 | Ohlsson . | |
| 3,597,843 | 8/1971 | Kettlestrings . | |
| 3,710,444 | 1/1973 | Fishman | 30/265 |
| 4,283,853 | 8/1981 | Fazzini | 30/265 |
| 4,574,480 | 3/1986 | Dunn | 30/265 X |

*Primary Examiner*—E. R. Kazenske
*Assistant Examiner*—Willmon Fridie, Jr.

[57] ABSTRACT

An envelope opener is formed of a rectangular casing having a central transverse guide slot, two cutting disks project into the slot from either side and have mutually interfacing edge portions thereat. A spring resiliently maintains the edge portions of the disks in constant contact in the slot. The guide slot has an upwardly convex bottom surface to reduce friction of an envelope being guided through the slot.

4 Claims, 11 Drawing Figures

ENVELOPE OPENER

FIELD OF THE INVENTION

The present invention relates to envelope openers, particularly to an envelope opener of the hand-held type having improved features.

BACKGROUND OF THE INVENTION

Envelope openers of the prior art may be generally grouped as being power-operated or manually-operated, the latter group including those which are small enough to be held in one hand. For example the U.S. patent to Kettlestrings, issued Aug. 10, 1971 and bearing U.S. Pat. No. 3,597,843 discloses a pair of disks in a housing and having overlapping edge portions disposed in an envelope guide-slot. This device involves many elements, but more importantly the cutting means would tend to become loose after repeated use and thus cease to cut easily. Another U.S. patent to Fishman, issued Jan. 16, 1973, and having U.S. Pat. No. 3,710,444, discloses an apparatus with the same general shortcoming.

OBJECTS OF THE INVENTION

In view of the above, it is a first object of the present invention to provide a hand-held envelope opener which obviates the above-mentioned disadvantages.

It is another object of the invention to provide an envelope opener of the above type which is compact, long-lasting and very easy to use.

It is yet another object of the present invention to provide an envelope opener of the above type which minimizes the friction between the opener and an envelope to be cut open.

SUMMARY OF THE INVENTION

The above and other objects and advantages of the present invention are realized according to a preferred embodiment comprising: a casing made of suitable rigid material and having two spaced-apart recesses made therein, each recess being formed around a fixed axis. In each recess is disposed a circular cutting means, each of the latter being rotatable independently of the other.

Extending transversely between and partially intersecting the pair of recesses is an envelope guide-slot, preferably characterized in that it is upwardly convex for a reason explained herebelow.

An edge portion of one cutting means extends into the slot and overlaps the edge portion of the other cutting means which also extends into the slot, thereby forming cutting nips at the two transverse points where the cutting means begin to overlap.

An inventive feature of the invention is manifested by a biasing means adapted to resiliently bias the edge portion of one cutting means against the edge portion of the other cutting means which in turn abuts against the recess cover.

BRIEF DESCRIPTION OF THE DRAWINGS

The above will be more clearly understood by having referral to the preferred embodiment of the invention, illustrated by way of the accompanying drawings, in which.

Like numerals refer to like elements throughout the drawings.

DETAILED DESCRIPTION OF THE PREFERRED EMBODIMENT

Figure 2:
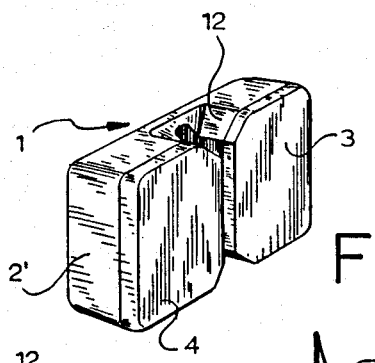
FIG. 2 is a perspective view of the device of FIG. 1.
Figure 3:
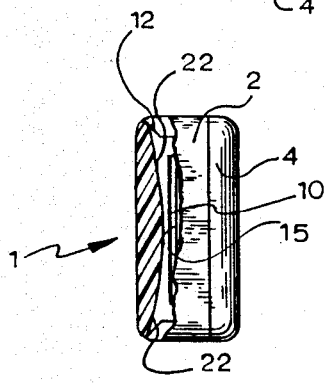
FIG. 3 is an end elevation partially in cross-section of the device of the invention.
Figure 4:
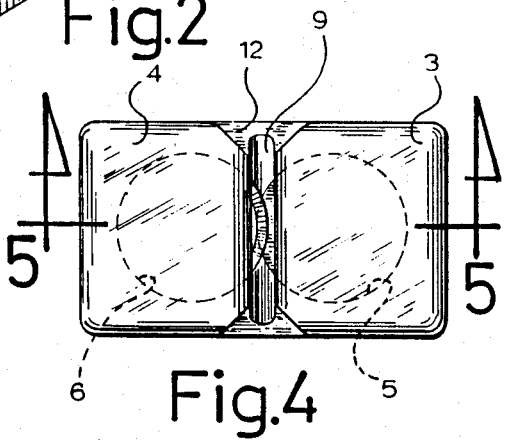
FIG. 4 is a top plan view of the device.

FIGS. 2 and 3 show the letter opener 1 formed of a rigid, preferably plastic casing 2 and a pair of covers 3 and 4.

Figure 1:
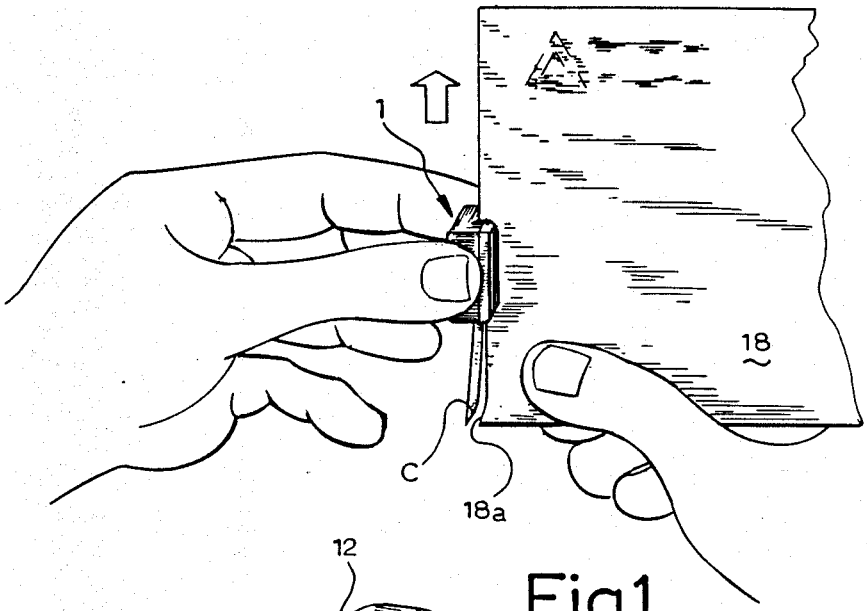
FIG. 1 is a perspective view showing how an envelope is opened with the device of the invention.

FIG. 1 shows how the opener may be grasped at the two end walls 2' with one hand and an envelope in the other hand.

Figure 5:
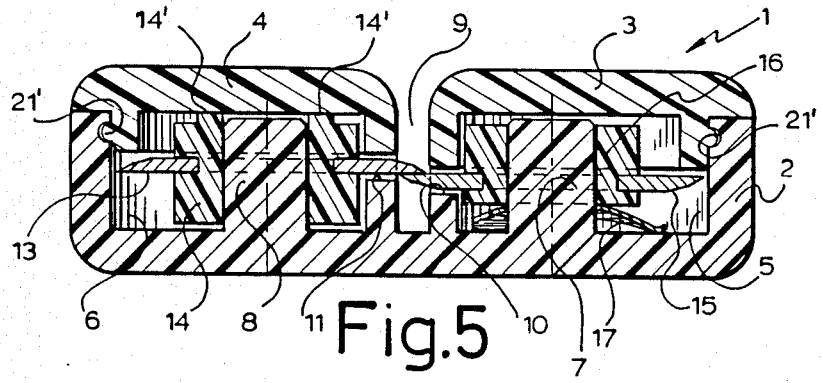
FIG. 5 is a cross-sectional view of the device taken along line 5—5 of FIG. 4.
Figure 6:
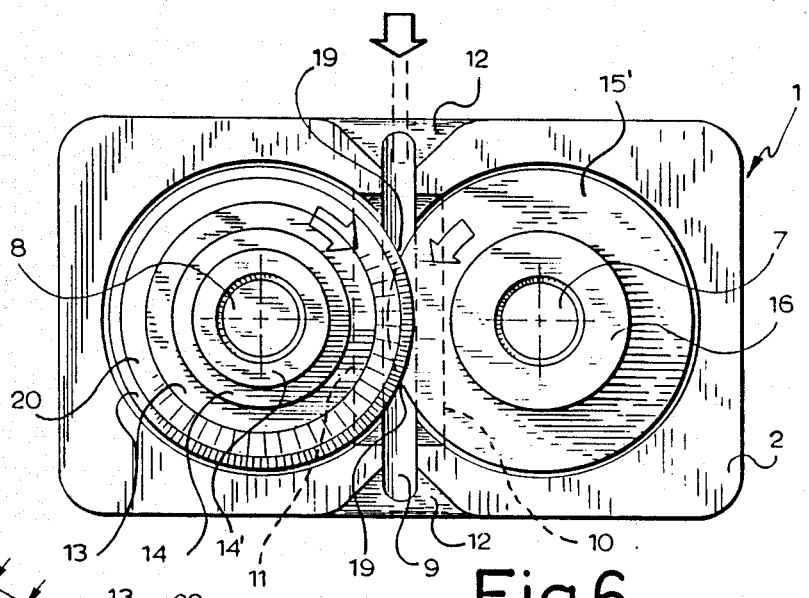
FIG. 6 is an enlarged top plan view of the device with both covers removed.

In FIGS. 5–6 casing 2 is best seen and has a rectangular solid shape, including a flat bottom. Casing 2 is made with a first circular recess 5 and a longitudinally-spaced second, identical circular recess 6. Both first recess 5 and second recess 6 are formed with upstanding identical axial pins 7 and 8 respectively.

Both recesses 5 and 6 have inner arc portions which are intersected by a transverse slot 9 extending from side to side of casing 2. Recess 5 is bounded at its inner arc portion by a step 10, while recess 6 is similarly bounded by a step 11 which is slightly higher than step 10. Slot 9 extends between these two steps 10, 11 and has outwardly flared openings 12 at both sides.

Recess 6 has disposed therein a rotatable cutting disk 13 embedded in a collar 14 rotatably fitting around axial pin 8.

Recess 5 also contains a rotatable cutting disk 15 embedded in another collar 16 which rotatably fits around axial pin 7.

Disks 13 and 15 overlap each other in slot 9, as shown in FIG. 5.

Figure 10:
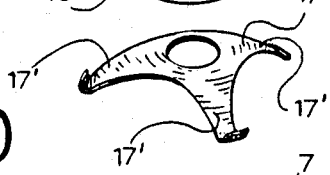
Figure 11:
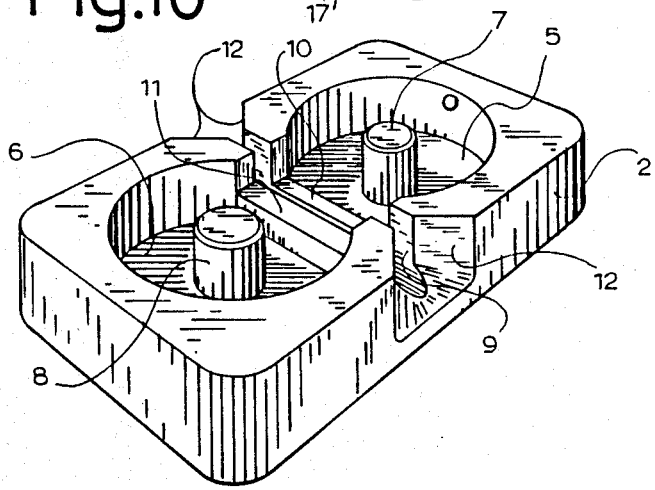
FIG. 11 is a perspective view of the casing.

The biasing means disclosed above consists of a spring 17, best shown in FIG. 10, fitted around pin 7 and having resilient legs 17' which rest against the bottom of recess 5. Spring 17 provides upward pressure against collar 16. An inner annular part 14' of the top surface of collar 14 is slightly raised such that it is the only part to contact the lower surface of cover 4. The top surface of collar 16 does not touch its cover 3 since the edge portion of cutting disk 15 presses against the edge portion underface of cutting disk 13.

It will be readily appreciated that spring 17 provides a biasing force against cutting disk 15 which is transmitted to disk 13 and hence upwardly against cover 4. Thus the two cutting disk overlapping portions are constantly held in operative contact. Annular part 14' serves to reduce friction as collar 14 rotates when an envelope 18 is moved through slot 9.

Envelope 18 may of course be fed into either side of slot 9 and into either cutting nip 19.

Covers 3 and 4 are removably held in any suitable manner. Each cover is formed with an integral depending annular portion 21 adapted to slidably fit in its respective recess and closely surround the upper portions of collars 14, 16. Each portion 21 has a tangential flat edge, as shown at 3', facing the slot 9 and flush with the registering side edge of cover 3 or 4. Each portion 21 has a tab 21' (FIG. 5) which snap fits into a registering cavity of the side wall of the respective recesses 5, 6.

Figure 7:
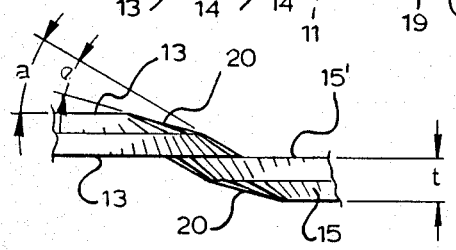
FIG. 7 is an elevation of the overlapped portions of the two cutting means.
Figure 8:
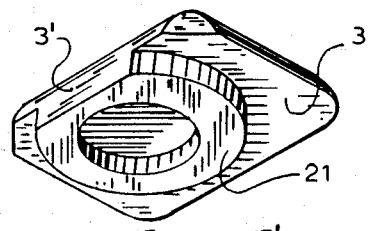
FIG. 8 is a perspective view of one cover for the device.
Figure 9:
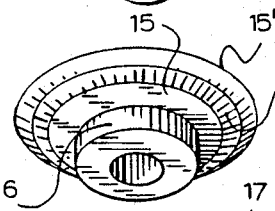
FIGS. 9 and 10 are perspective views of one cutting means and a biasing spring respectively.

FIG. 7 shows detail of cutting disks 13 and 15. Upper disk has a flat and lower disk 15 has a flat upper surface 15'. The circumferences of both disks are bevelled at an angle and along with reentrant portion 20 define an optimal angle e.

An additional novel feature of the invention is shown in FIG. 3 wherein the bottom surface 22 of slot 9 is upwardly convex to minimize friction as the envelope is inserted therethrough.

It is to be noted that if the corner C of envelope 18 is too thick the device of the invention may be placed at an angle and at an intermediate distance to start a cut thereat, as suggested at 18*a* in FIG. 1.

What we claim is:

1. An envelope opener comprising a rigid casing having a first recess and a second spaced-apart recess formed therein; each said recess being formed around a fixed axial pin; first and second collars, each being rotatably mounted on one of said axial pins; a first cutting disk, being embedded into an intermediate radially outward annular cavity in said first collar, and a second cutting disk, being embedded into an intermediate radially outward annular cavity in said second collar; a guide-slot extending transversely of said casing between and partially intersecting said recesses; each said cutting disk having a radially outward edge portion extending in said guide-slot in overlapping relationship with the other cutting disk edge portion thereby defining two transversely-spaced cutting nips; a compression spring, fitted around the axial pin of said first collar and intermediate said first collar and the bottom of said first recess; said first cutting disk radially outward edge portion being in a lower position relative to said radially outward edge portion of the second cutting disk in said slot; two covers to close said casing on both sides of said slot; said compression spring thereby upwardly biasing said first cutting disk against said second cutting disk; and a raised inner annular part being formed in the top surface of said second collar, so as to frictionally contact the inner surface of the corresponding said cover.

2. A cutting device for shearingly opening an edge portion of an envelope, comprising a pair of similar first and second casings, each having a top and a bottom wall and at least two opposite side walls, a strip plate interconnecting said bottom walls in coplanar fashion to define a horiz ontal channel between said casings; first and second shafts, integral to and upwardly projecting from the bottom wall of said first and second casings, respectively, to the corresponding casing top walls, and around which are rotatively freely mounted first and second hub members, respectively; first and second cutting disks, embedded in the radially outer peripheral edge of said first and second hub members, respectively, and each having a radially outer edge portion engaging through an intermediate section of said channel; wherein said cutting disks edge portions overlap each other; and a spring member mounted around said first casing shaft below said first hub member, to upwardly bias said first hub member, so as to bias said first cutting disk edge portion upwardly against the underface of said second cutting disk edge portion, whereby said second hub member frictionally abuts against said second casing top wall but said first hub member remains spaced from said first casing top wall, said envelope edge portion engageable through either end of said channel to rotate said cutting disks during its displacement therealong.

3. A cutting device as in claim 2, wherein the top face of said strip plate is convex in longitudinal vertical section.

4. A cutting device as in claim 2, wherein the top walls of both casings are removable covers for facilitating maintenance of the cutting disks.

* * * * *